US007719476B2

(12) United States Patent
Ke et al.

(10) Patent No.: US 7,719,476 B2
(45) Date of Patent: May 18, 2010

(54) COMPLEX ANTENNA WITH PROTECTION MEMBER

(75) Inventors: Yun-Long Ke, Tu-Cheng (TW); Yao-Shien Huang, Tu-Cheng (TW); Shang-Jen Chen, Tu-Cheng (TW); Chen-Ta Hung, Tu-Cheng (TW); Po-Kang Ku, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 294 days.

(21) Appl. No.: 11/900,387

(22) Filed: Sep. 11, 2007

(65) Prior Publication Data

US 2008/0062054 A1 Mar. 13, 2008

(30) Foreign Application Priority Data

Sep. 11, 2006 (TW) ..... 95133416 A

(51) Int. Cl.
*H01Q 21/00* (2006.01)

(52) U.S. Cl. ..... 343/725; 343/702; 343/900

(58) Field of Classification Search ..... 343/702, 343/900, 725

See application file for complete search history.

(56) References Cited

U.S. PATENT DOCUMENTS 5,617,105 A * 4/1997 Tsunekawa et al. ..... 343/702
2007/0057864 A1* 3/2007 Tsai ..... 343/900

FOREIGN PATENT DOCUMENTS

TW 560706 11/2003

* cited by examiner

*Primary Examiner*—Douglas W Owens
*Assistant Examiner*—Dieu Hien T Duong
(74) *Attorney, Agent, or Firm*—Wei Te Chung; Andrew C. Cheng; Ming Chieh Chang

(57) ABSTRACT

A complex antenna adapted for used in a electronic device, comprises a rod antenna, a helical antenna, a dipole antenna comprising a radiating element and a grounding element, and a feeding line. The feeding line comprises an inner conductor electrically connecting to the radiating element at a first joint position and an outer conductor electrically connecting to the grounding element at a second joint position. The first joint position is tightly covered by a insulating tubular element for avoiding to be destroyed and oxidized.

19 Claims, 4 Drawing Sheets

COMPLEX ANTENNA WITH PROTECTION MEMBER

BACKGROUND OF THE INVENTION

1. Field of the Invention

The present invention relates generally to an antenna, and more particularly to a complex antenna having desired operating performance.

2. Description of the Prior Art

Wireless communication devices, such as cellular phones, notebook computers, electronic appliances, and the like, are normally equipped with an antenna that serves as a medium for transmission and reception of electromagnetic signals, such as date, audio, image, and so on. The antenna can be built outside or inside of the devices. Usually, an external antenna is not easily disturbed by inner components of the electrical device and is easily adjusted by user for achieving desired operating performance. Dipole antenna is a kind of traditional external antenna. The length of a radiating element or a grounding element of a traditional dipole antenna substantially equals to ½ wavelength (λ). While, when used in long distance transmission/reception, general dipole antenna generally has weak gain and undesired operating performance.

Taiwan Patent No. 560706 disclosed a complex antenna comprising a dipole antenna, a helical antenna, and a rod antenna which connect to one another in series. The complex antenna improves the gain of the antenna and the communication distance of the antenna is fairly increased. However, the connection area between the dipole antenna and the inner conductor of the feeding line has no any additional protection. So, the connection area is not only easy to be broken but also easy to be oxidized.

Hence, in this art, a complex antenna to overcome the above-mentioned disadvantages of the prior art will be described in detail in the following embodiment.

BRIEF SUMMARY OF THE INVENTION

A primary object, therefore, of the present invention is to provide a complex antenna with protection member to protect connection area between feeding line and radiating element.

In order to implement the above object and overcome the above-identified deficiencies in the prior art, the complex antenna comprises a rod antenna, a helical antenna, a dipole antenna comprising a radiating element and a grounding element, an insulating tubular element, and a feeding line; the feeding line comprises an inner conductor electrically connecting to the radiating element of the dipole antenna at a first joint position and an outer conductor electrically connecting to the grounding element of the dipole antenna at a second joint position; the rod antenna, the helical antenna, and the dipole antenna are connected in series; the first joint position is covered by the insulating tubular element.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
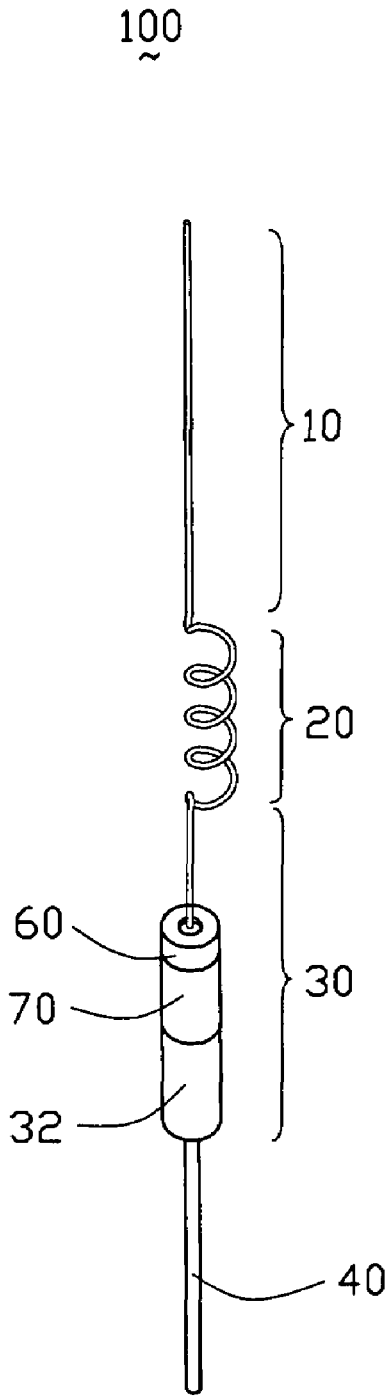
FIG. 1 is a perspective view of a complex antenna in accordance with the present invention.
Figure 2:
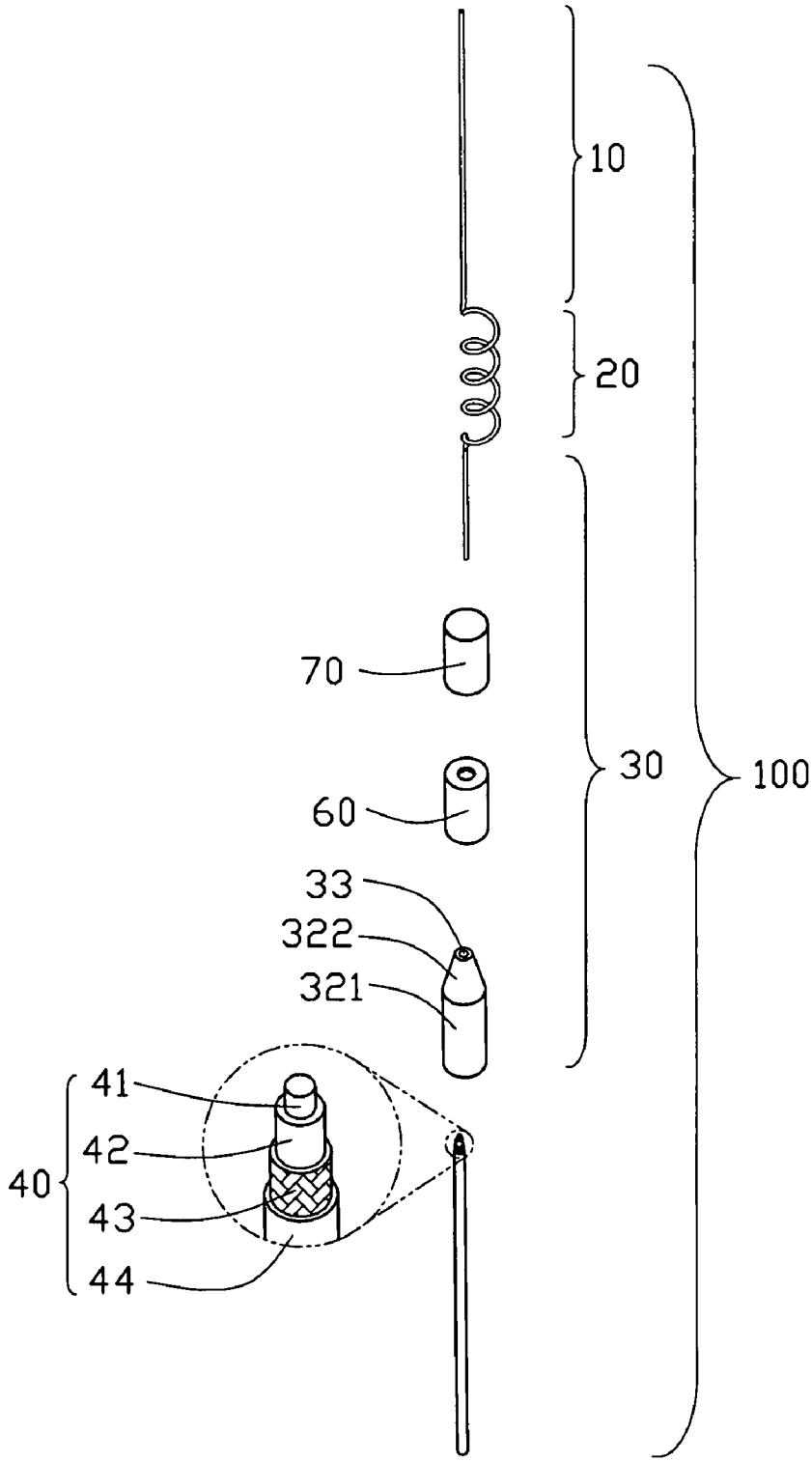
FIG. 2 is an exploded view of FIG. 1.
Figure 3:
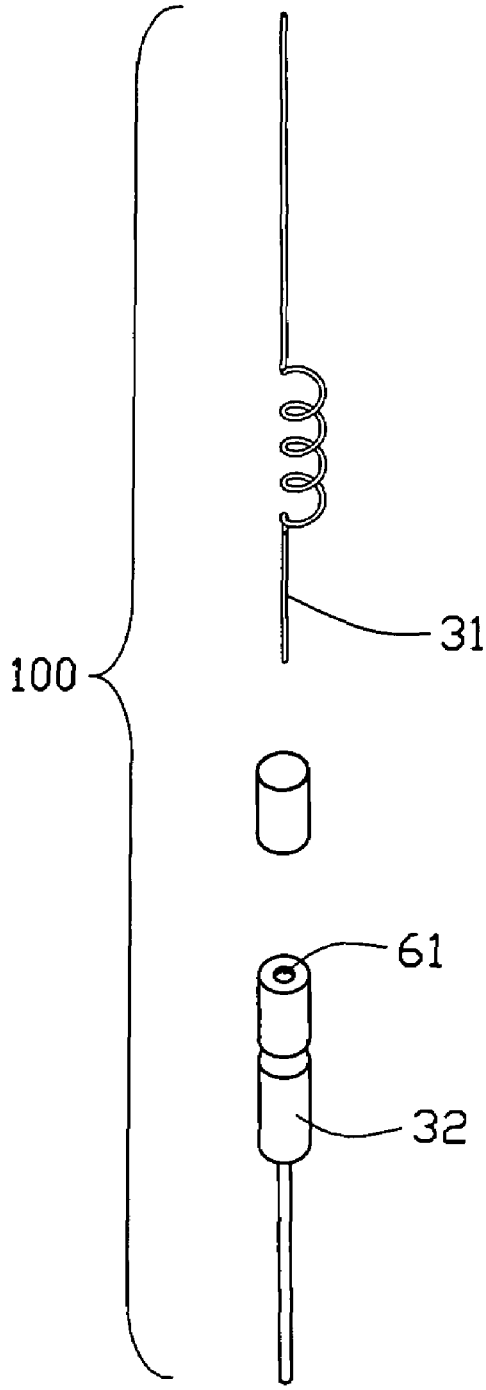
FIG. 3 is a partly exploded view of FIG. 1.
Figure 4:
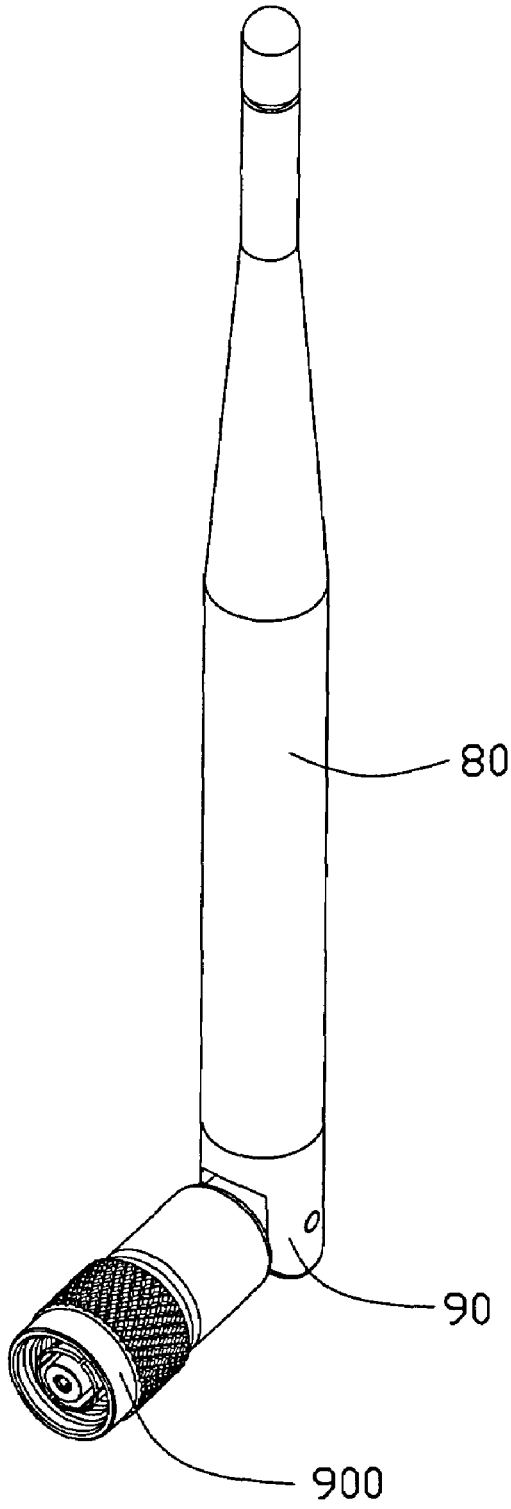
FIG. 4 is a perspective view illustrating using environment of the complex antenna in accordance with the present invention with a shell and an RF connector assembled therewith.

Referring to FIG. 1 to FIG. 4, a complex antenna 100 according to the present invention comprises three kinds of traditional antennas, a top rod antenna 10, a middle helical antenna 20, and a bottom dipole antenna 30. The three kinds of traditional antennas are connected with one another in series. The dipole antenna 30 comprises a radiating element 31 and a grounding element 32 each having a length substantially equaling to ¼ wavelength. The radiating element 31 of the dipole antenna 30 extends downwardly from a bottom free end of the helical antenna 20 and the rod antenna 10 is extends upwardly from a top free end of the helical antenna 20.

A feeding line 40 connects to the dipole antenna 30. The feeding line 40 has an inner conductor 41 electrically connecting to the radiating element 31 at a first joint position, an inner insulator 42 covering the inner conductor 41, an outer conductor 43 connecting to the grounding element 32, and an outer insulator 44 covering the outer conductor 43. The grounding element 32 made from sheet metal comprises a column-shape main portion 321 at bottom and a cone-shaped upper portion 322 at top. The upper portion 322 has a hole 33 there rough for permitting the inner conductor 41, the inner insulator 42, and the outer conductor 43 protruding beyond the upper portion 322. The main portion 321 has an aperture (not shown) communicating with the hole 33 of the upper portion 322 just allowing the feeding line 40 protruding through. The diameter of the aperture is slightly large than that of the hole 33. The outer conductor 43 of the feeding line 40 is electrically soldered at the top edge of the hole 33 at a second joint position or can be turned down to wrap on the outer periphery of upper portion 322 and then soldered on upper portion 322. An insulating elastic tubular element 60 defines a run-through hole, with upper portion 322 partially received in the run-through hole, thus, the second joint position is covered by insulating elastic tubular element 60. That is the bottom of the insulating tubular element 60 sits on the grounding element 32 and abuts against the upper portion 322 of the grounding element 32. The insulating tubular element 60 encloses the first joint position and the second joint position and tightly contacts to the first joint position and the second joint position. So, the first and second joint positions are not easy to be destroyed and broken, and not easy to be oxidized and keeps favorable electrical connection.

A metal tubular element 70 is a thin metal sheet and wraps on a lower portion of the insulating tubular element 60 and the upper portion 322 of the grounding element 32. The bottom of the metal tubular element 70 abuts against the main portion 321 of the grounding element 32. The metal tubular element 70 and the grounding element 32 together form a capacitance to achieve impedance match for the complex antenna 100. The second joint position is regarded as a center of the metal tubular element 70 along longitudinal direction. One half part of the metal tubular element 70 extends upwards from the center and the other half part extends downwards from the center. An inner surface of the metal tubular element 70 contacting the insulating tubular element 60 and the grounding element 32 is covered with conductive adhesive. The insulating tubular element 60 is elastic. So, the metal tubular element 70 can be pressed and adhibitted to the insulating tubular element 60. The metal tubular element 70 is made from aluminum foil, copper foil, or other metals.

The rod antenna 10, the helical antenna 20, and the radiating element 31 of the dipole antenna 30 are made from folding a whole metal rod or soldering three separate metal rods. The installing process of the complex antenna 100 is as follows. Firstly, protruding the feeding line 40 through the aperture and the hole of the grounding element 32 until the inner conductor 41, the inner insulator 42, and the outer conductor 43 partially exposed beyond the edge of the upper portion 322. Secondly, inserting the radiating element 31 of the dipole antenna 30 through the run-through hole of the insulating tubular element 60. Thirdly, the inner conductor 41 electrically connects to the radiating element 31 and the outer conductor 43 electrically connects to the edge of the hole 33 to form the first and second joint positions as described above. Fourthly, pulling down the insulating tubular element 60 to abut against the upper portion 322 and cover the first and second joint positions. Fifthly, the metal tubular element 70 is adhibitted to the insulating tubular element 60 and the grounding element 32 with upper portion of the insulating tubular element 60 and the main portion 321 exposed in outside. Thus, the complex antenna 100 is achieved. Referring to the FIG. 4, A shell 80 covering the complex antenna 100 connects to the RF connector 900 via a hinge 90. The complex antenna 100 installs on an electrical device and exposed to the free space.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A complex antenna adapted for used in an electronic device, comprising:

a rod antenna;

a helical antenna;

a dipole antenna comprising a radiating element and a grounding element; a feeding line, comprising an inner conductor electrically connecting to the radiating element of the dipole antenna at a first joint position and an outer conductor electrically connecting to the grounding element of the dipole antenna at a second joint position;

an insulating tubular element; and a metal tubular element partially covering the insulating tubular element and the grounding element; wherein the rod antenna, the helical antenna, and the dipole antenna are connected in series;

the first joint position is tightly covered by the insulating tubular element.

2. The complex antenna as claimed in claim 1, wherein the insulating tubular element further covers the second joint position.

3. The complex antenna as claimed in claim 2, wherein the outer conductor is turned down to be soldered on the outer periphery of the grounding element.

4. The complex antenna as claimed in claim 1, wherein the grounding element comprises a main portion with an aperture at bottom and a upper portion with a hole at top, and wherein the insulating tubular element abuts against the upper portion.

5. The complex antenna as claimed in claim 4, wherein the feeding line protrudes through the aperture and the hole of the grounding element, and wherein the outer conductor is soldered at the top edge of the hole.

6. The complex antenna as claimed in claim 1, wherein further comprising a shell enclosing the complex antenna therein.

7. The complex antenna as claimed in claim 1, wherein the radiating element of the dipole antenna connects at the bottom of the helical antenna, the rod antenna connects at the top of the helical antenna.

8. The complex antenna as claimed in claim 1, wherein the rod antenna, the helical antenna, and the radiating element of the dipole antenna are made from the same metal rod.

9. The complex antenna as claimed in claim 1, wherein the radiating element and the grounding element of the dipole antenna are apart from each other.

10. The complex antenna as claimed in claim 1, further comprising a shell enclosing the complex antenna therein.

11. The complex antenna as claimed in claim 1, wherein the radiating element of the dipole antenna electrically connects to the bottom of the helical antenna, the rod antenna electrically connects to the top of the helical antenna.

12. A complex antenna adapted for used in an electronic device, comprising:

a rod antenna;

a helical antenna;

a dipole antenna, comprising a radiating element and a grounding element; and a feeding line, comprising an inner conductor and an outer conductor; wherein the rod antenna, the helical antenna, and the dipole antenna are connected in series;

the inner conductor electrically connects to the radiating element at a first joint position and the outer conductor electrically connects to the grounding element at a second joint position; the dipole antenna is partially covered by a metal tubular element electrically contacting to the grounding element of the dipole antenna and insulated from the radiating element of the dipole antenna.

13. The complex antenna as claimed in claim 12, wherein the metal tubular element encloses the second joint position while not encloses the first joint position.

14. The complex antenna as claimed in claim 12, further comprising an insulating tubular element covers the first joint position, the metal tubular element tightly covers the insulator tubular element and the grounding element of the dipole antenna.

15. The complex antenna as claimed in claim 14, wherein the second joint position is covered by the insulating tubular element.

16. A complex antenna adapted for used in an electronic device, comprising:

at least one of a rod antenna and a helical antenna;

a dipole antenna comprising a radiating element and a grounding element surrounding the radiating element;

a feeding line comprising an inner conductor electrically connecting to the radiating element of the dipole antenna at a first joint position and an outer conductor electrically connecting to the grounding element of the dipole antenna at a second joint position; and an insulating tubular element seated upon the grounding element and at least partially covered by a metallic circumferential element; wherein the first joint position is tightly covered by the insulating tubular element.

17. The complex antenna as claimed in claim 16, wherein said metallic circumferential element mechanically and electrically contacts the grounding element.

18. The complex antenna as claimed in claim 16, wherein said metallic circumferential element is a metal foil.

19. The complex antenna as claimed in claim 16, wherein the grounding element provides a truncated cone section at thereof an upper section where said insulating tubular element is seated.

* * * * *